United States Patent [19]

Gruber et al.

[11] 4,453,358

[45] Jun. 12, 1984

[54] INSULATED ONE-PIECE ROOF

[75] Inventors: Hermann Gruber, Leverkusen; Wolfgang Wellner, Cologne; Hermann Diehl, Mannheim; Dieter Mönig, Odenthal, all of Fed. Rep. of Germany

[73] Assignees: Bayer Aktiengesellschaft, Leverkusen; Correcta, GmbH, Bad Wildungen, both of Fed. Rep. of Germany

[21] Appl. No.: 295,391

[22] Filed: Aug. 24, 1981

[30] Foreign Application Priority Data

Sep. 3, 1980 [DE] Fed. Rep. of Germany ..... 3033091

[51] Int. Cl.[3] ..... E04C 1/00

[52] U.S. Cl. ..... 52/309.8

[58] Field of Search ..... 52/309.8

[56] References Cited

U.S. PATENT DOCUMENTS

| | | | |
|---|---|---|---|
| 3,280,528 | 10/1966 | Dunlap | 52/309.8 |
| 3,466,222 | 9/1969 | Curtis | 52/309.8 |
| 3,468,771 | 9/1969 | Pedlow | 52/309.8 |
| 3,496,058 | 2/1970 | Schroter | 52/309.8 |
| 3,511,007 | 5/1970 | Babcock | 52/309.8 |
| 3,579,937 | 5/1971 | Lukens | 52/309.8 |
| 3,605,369 | 9/1971 | Merrill | 52/309.8 |
| 3,619,343 | 11/1971 | Freeman | 52/309.8 |
| 3,619,437 | 11/1971 | McDonald | 52/309.8 |
| 4,259,817 | 4/1981 | Elliott | 52/309.8 |
| 4,374,687 | 2/1983 | Yamamoto | 52/309.8 |

*Primary Examiner*—John E. Murtagh
*Assistant Examiner*—Kathryn Ford
*Attorney, Agent, or Firm*—Gene Harsh; Joseph C. Gil

[57] ABSTRACT

The present invention relates to an insulated one-piece roof for use over heatable rooms comprising at least three layers, the first layer being a solid or other load-bearing construction, the second layer being an insulating board and the third layer being a prepared roofing, said one-piece roof further characterized in that the characteristics value $\mu \cdot s$ where $\mu$ is the diffusion resistance index and s is the layer thickness of the constituent material of the vertically adjacent layers, decreases outwardly, said prepared roofing being firmly joined to the underlying insulating board and having a characteristic value $\mu \cdot s$ of less than 4 m.

4 Claims, 1 Drawing Figure

INSULATED ONE-PIECE ROOF

BACKGROUND OF THE INVENTION

This invention relates to an insulated one-piece roof over heatable rooms, consisting of at least three layers, namely a solid or other load-bearing system, an insulating board and prepared roofing.

In one known roof, a bitumen-coated concrete ceiling is covered by a levelling layer to which a vapor sealing layer is applied. The actual insulating layer is then applied which is covered with a single-layer plastics sheet and then a three-layer bitumen felt. Following the application of another protective layer, the roof structure is weighted with gravel or receives a reflecting layer, for example of chippings or slate and the like.

The roof construction often used in practice is extremely complicated and hence troublesome. If the vapor sealing layer is not satisfactorily laid or if it is subsequently damaged (for example by settlement) water vapor penetrates through to the prepared roofing resulting in bulges and ultimately tearing of the roofing or, in the event of condensation, soaking of the construction. Another disadvantage is that the loose plastic sheeting (for example PVC), which must be laid in combination with a barrier layer due to plasticizer migration, must be weighted with pebbles to prevent them from being dislodged by wind. Apart from the additional gravelling required, this adds to the cost of the concrete ceiling which must be made thicker because of the increased weight thereon.

The object of the present invention is to provide an insulated one-piece roof which may readily be made from prefabricated sections, which does not require any additional ballast to prevent it from lifting, which is impervious to surface water and, despite the absence of vapor sealing layer underneath, does not have any tendency towards bubble formation in the prepared roofing caused by the diffusion of water vapor.

BRIEF DESCRIPTION OF THE DRAWING

The FIGURE illustrates one embodiment of the present invention.

DESCRIPTION OF THE INVENTION

Figure 1:
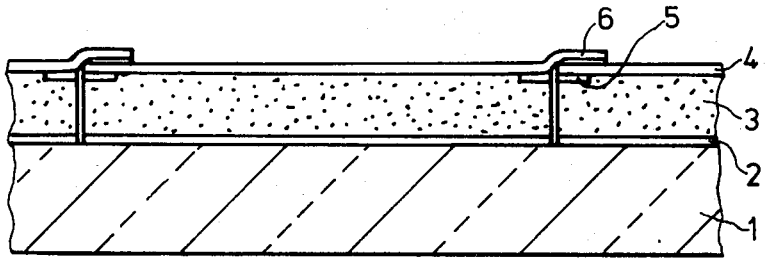

According to the present invention, the above objects are achieved in that the characteristic value $\mu \cdot S$, where $\mu$ is the diffusion resistance coefficient and s is the layer thickness of the constituent materials of the vertically adjacent layers, decreases outwardly and in that the prepared roofing, which is fixedly connected to the underlying boards of insulating foam is impervious to surface water and has a characteristic value of less than 4 m and, more particularly, less than 1.5 m.

It has surprisingly been found that with the claimed roof construction insulated, for example, in accordance with the relevant DIN Standard, it is possible on the one hand to dispense with the expensive vapor sealing layer without any danger of condensation and hence dampness and vapor pressure problems while, on the other hand, the roof is satisfactorily impervious to surface water. It is also surprising that, in spite of the largely surface-to-surface bond, which eliminates the need for levelling layers and separating layers, the roof is safely prevented from lifting without any need for additional adhesives and without any cracks or other damage occurring in the prepared roofing for the insulating board thicknesses normally used.

In one particular embodiment, the prepared roofing consists of polyether-based urethanes having breaking elongations according to DIN 53504 of at least 120% and diffusion resistance indices of at most 4000.

A prepared roofing on this basis retains its high breaking elongation, even at low temperatures, which is of particular advantage for roofs.

In another embodiment, the prepared roofing consists of reaction products of:

(a) polyether-based urethanes containing carbamic acid aryl ester groups, with (b) organic polyamines.

Another advantages is that, because free isocyanate groups are blocked, there is no sensitivity to moisture during production of the prepared roofing, with the result that no $CO_2$ gas bubbles are formed in the roofing.

To produce the polyether-based urethane containing carbamic acid aryl ester groups, polyethers known per se in polyurethane chemistry, particularly polypropylene glycols having molecular weights in the range from 500 to 6000 and preferably in the range from 2000 to 4000, are reacted with excess quantities of organic diisocyanates, such as for example toluene-2,4-diisocyanate, mixtures thereof with toluene-2,6-diisocyanate of diphenyl methane-4,4'-diisocyanate, to form the corresponding NCO-prepolymers containing from 0.5 to 6.0% and preferably from 1.5 to 3.5% by weight of terminal isocyanate groups. The NCO-terminated prepolymers thus obtained are reacted with phenols, preferably $C_4$–$C_{12}$-alkyl phenols, for example 4-tert.-butyl phenol, isononyl phenol or dodecyl phenol, to block the free isocyanate groups.

Suitable cross-linking agents for the polyether-based urethane containing carbamic acid aryl ester groups, thus obtained include any organic polyamines containing at least two primary and/or secondary amino groups. Particularly suitable polyamines are, for example, cycloaliphatic diamines.

In the reaction of the polyether-based urethanes containing carbamic acid aryl ester groups with the organic polyamines, the reactants are generally used in stoiciometric quantities, although the amine may be used in a quantity exceeding or falling below the stoiciometric quantity by up to 15%. The reactants (a) and (b) are preferably reacted at temperatures in the range from 10° C. to 150° C.

In one particular embodiment, the insulating boards consist of closed-cell polyurethane foam.

The combination of this sheet of blocked polyisocyanate with polyurethane insulating boards prevents undesirable warping under humid conditions.

In another embodiment, the insulating boards consists of strips arranged side by side and joined together in the factory by a roofing. Using this roll roofing, which may even have a different thickness for draining off the water, it is possible to cover relatively large areas.

As in the case of the boards, the prepared roofing may project on certain sides for overlaps.

The insulating materials may be bonded to the roof substrate by any known bonding techniques, for example using hot bitumen or cold adhesives, or by mechanical fixing without using adhesives.

The polyurethanes sealing layers may be bonded to one another by known bonding techniques. It is particularly advisable to use a one-component or two-component polyurethane reaction adhesive mixture for this purpose because it has the same property spectrum as the polyurethane layer.

One embodiment of the invention is illustrated by way of example in the accompanying drawing and described in detail in the following. The FIGURE is a section through a roof structure.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An insulated one-piece roof for use for heatable rooms comprising at least three layers, the first layer being a solid or other load-bearing construction, the second layer being an insulating board and the third layer being a prepared roofing, said one-piece roof further characterized in that the characteristic value $\mu \cdot s$, where $\mu$ is the diffusion resistance index and s is the layer thickness of the constituent material, of the vertically adjacent layers, decreases outwardly, said prepared roofing being firmly joined to the underlying insulating board and having a characteristic value $\mu \cdot s$ of less than 4m, and further characterized in that the prepared roofing consists of a polyether-based urethane having a breaking slongation according to DIN 53504 of at least 120% and a diffusion resistance index of at most 4,000.

2. An insulated one-piece roof as claimed in claim 1 characterized in that the insulating board consists of closed-cell polyurethane foam.

3. An insulated one-piece roof for use for heatable rooms comprising at least three layers, the first layer being a solid or other load-bearing construction, the second layer being an insulating board and the third layer being a prepared roofing, said one-piece roof further characterized in that the characteristic value $\mu \cdot s$, where $\mu$ is the diffusion resistance index and s is the layer thickness of the constituent material, of the vertically adjacent layers, decreases outwardly, said prepared roofing being firmly joined to the underlying insulating board and having a characteristic value $\mu \cdot s$ of less than 4m, and further characterized in that the prepared roofing consists of the elastomeric reaction product of:

(a) a polyether-based urethane containing carbamic acid aryl ester groups with (b) an organic polyamine.

4. An insulated one-piece roof as claimed in claim 1 characterized in that the insulating board consists of closed-cell polyurethane foam.

* * * * *